United States Patent [19]

Sadigh-Behzadi

[11] 4,365,860

[45] Dec. 28, 1982

[54] INTEGRAL HOUSING INSULATION-PIERCING CONNECTOR

[75] Inventor: Amir-Akbar Sadigh-Behzadi, Van Nuys, Calif.

[73] Assignee: Thomas & Betts Corporation, Raritan, N.J.

[21] Appl. No.: 221,395

[22] Filed: Dec. 30, 1980

[51] Int. Cl.[3] ..... H01R 11/20; H01R 13/514

[52] U.S. Cl. ..... 339/97 P; 339/176 MF; 339/217 S

[58] Field of Search ..... 339/97 P, 98, 99 R, 339/176 MF, 17 F, 97 R, 217 S

[56] References Cited

U.S. PATENT DOCUMENTS

| | | | |
|---|---|---|---|
| 3,189,863 | 6/1965 | Leach | 339/99 |
| 3,434,093 | 3/1969 | Wedekind | 339/99 R |
| 3,444,506 | 5/1969 | Wedekind | 339/99 R |
| 3,656,093 | 4/1972 | Kinkaid | 339/217 S |
| 3,820,058 | 6/1974 | Friend | 339/99 |
| 3,912,354 | 10/1975 | Campbell et al. | 339/99 R |
| 3,930,708 | 1/1976 | Wedekind et al. | 339/99 |
| 3,964,816 | 6/1976 | Narozny | 339/221 M X |
| 3,993,393 | 11/1976 | Worth | 339/99 |
| 4,068,912 | 1/1978 | Hudson, Jr. | 339/99 R |
| 4,118,096 | 10/1978 | Takahashi | 339/99 |

OTHER PUBLICATIONS

Berg, "Technishche Daten", No. 15.T2.06D-12/79.

*Primary Examiner*—John McQuade
*Assistant Examiner*—John S. Brown
*Attorney, Agent, or Firm*—Robert M. Rodrick; Salvatore J. Abbruzzese; Jesse Woldman

[57] ABSTRACT

A housing includes a channel for receiving a multiconductor flat cable between integrally formed cover and base. A plurality of slots, which are of stepped width in the base and which share a common depth in the base and cover, support insulation-piercing contacts for movement in the housing into electrical connection with the cable.

15 Claims, 11 Drawing Figures

INTEGRAL HOUSING INSULATION-PIERCING CONNECTOR

FIELD OF THE INVENTION

This invention relates to electrical connectors for mass terminating multiconductor flat cable and pertains more particularly to connectors of this type which employ an integral housing and insulation-piercing electrical contacts.

BACKGROUND OF THE INVENTION

Commercially available electrical connectors for insulation-piercing mass termination of multiconductor flat cable typically comprise a plastic base supporting contact elements with insulation-piercing end portions thereof in facing relation to a cover member which is non-integral with the base. Through complemental latch structure on the cover and base, the cover is normally disposed in a location sufficiently spaced from the base to permit insertion of the multiconductor flat cable. A crimping tool then applies pressure to the base and cover in a closing distance direction such that the insulation-piercing contact portions displace the cable insulation and find electrical engagement with the conductors. At this juncture in the assembly, the cover is disposed in a closer relation to the base and in a second latched position. The cable is typically then routed atop the cover and a strain relief member is placed in straddling relation to the cover and crimped downwardly thereon to buffer the insulation-pierced cable connections from tensile stresses imposed on the cable remotely from the connection location. While such multipart connectors have served the industry well, there is present interest in a connector having an integral arrangement of base and cover, i.e., a single plastic structure defining both components in fixed relation and providing a channel therebetween for receiving the multiconductor flat cable.

In another aspect of present-day multiconductor flat cable connector technology, the art has seen an emphasis upon insulation-piercing contacts of open box and like spaced three-dimensional configuration. In manufacturing such contacts, plural forming steps are necessary. Initially, a contact strip may be stamped in suitable flat configuration. The contact strip is then subjected to forming operations at both opposed end portions of contact elements defined therein. Thus, at the insulation-piercing end portion of the contact elements, the flat metal is rolled or otherwise worked into such spaced three-dimensional configuration. The opposite contact end portion is also frequently rolled into pin or socket configuration. Finally, the contact strip is subjected to cutting operations to individualize the contacts. While a lesser number of operations would be involved if the contact elements were to be used in such flat condition in which they exist in the strip as stamped, it is believed that the industry continues to indicate a preference for the more full-bodied box configuration for insulation-piercing contacts, presumably by reason of anticipated performance disadvantage in flat contact elements.

SUMMARY OF THE INVENTION

The present invention has as its primary object the provision of an improved electrical connector of type having integral base and cover and employing contacts in flat configuration.

In attaining the above and other objects, the invention provides an electrical connector having an integral cover and base and defining a cable-receiving channel therebetween, the housing having a plurality of slots providing for contact residence and movement in the housing. Each slot has an extent adjacent the cable-receiving channel which exhibits a constant geometry extending into both the cover and the base. Flat contacts employed in the connector have an insulation-piercing end portion of constant geometry compatible with residence in such slot extent. As is discussed more fully below, each such slot extends throughout at least the base into registry with an access opening. Throughout such full slot extent, the slot exhibits a depth, at least in a side margin, equal to such constant depth and the contact element includes a stem depending from the insulation-piercing portion thereof which exhibits a side margin thickness compatible with residence thereof in the full slot extent.

The foregoing and other objects and features of the invention will be further evident from the following detailed description of preferred embodiments thereof and from the drawings wherein like reference numerals are used to identify like parts throughout.

DETAILED DESCRIPTION OF THE PREFERRED EMBODIMENTS

Figure 1:
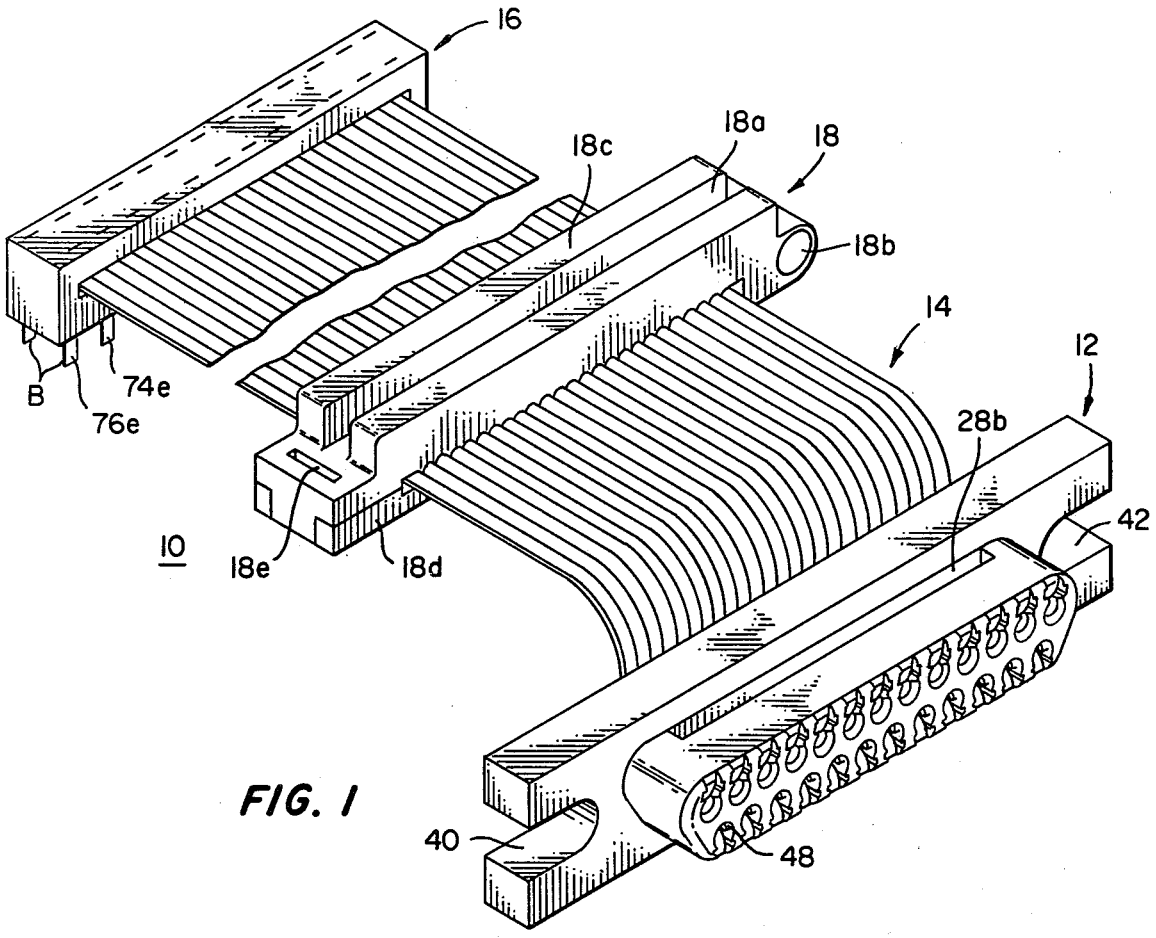
FIG. 1 is a perspective illustration of a connection harness employing connectors in accordance with the invention.
Figure 8:
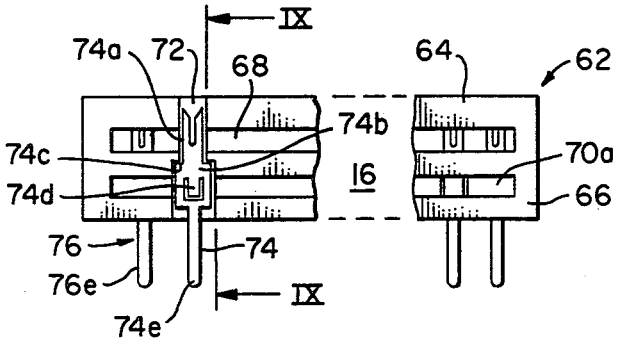
FIG. 8 is a front elevational view of the PCB connector of FIG. 1, partly broken away to show interior detail.
Figure 9:
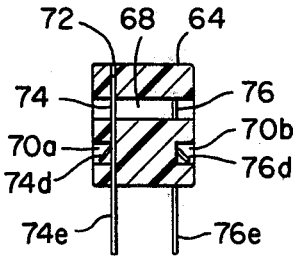
FIG. 9 is a sectional elevation of the FIG. 8 connector as seen along broken plane IX—IX of FIG. 8.
Figure 10:
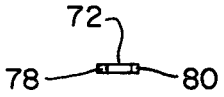
FIGS. 10 and 11 are schematic illustrations as seen from the underside of the showings of FIGS. 8 and 9, respectively, with the contacts removed for clarity.
Figure 11:
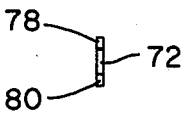

Referring to FIG. 1, cabling harness 10 is illustrative of subsystems which may be assembled in accordance with the invention and provides for electrical transition from a printed circuit board (PCB) to a D-connector having terminal pins extending therefrom. D-connector 12, of type having sockets for receiving such pins mass terminates multiconductor flat cable 14 at one end thereof and PCB connector 16 mass terminates cable 14 at its opposite end, connector 16 having depending terminal blades B which may be inserted in PCB-mounted sockets and soldered thereto. Transition electrical connection is thus provided by harness 10 as between circuitry connected to the PCB sockets and circuitry connected to the pin-type D-connector. For purposes of providing strain relief for the electrical connections within connectors 12 and 16, one or more strain relief devices 18 may be disposed along the run of cable 14. Devices 18 may be comprised of a plastic body defining a channel 18*a* for interference fit with a support substrate and having an integral hinge 18*b* providing for opposed sections 18*c* and 18*d* to tightly engage cable 14 through undulations in surface of the sections presented to the cable. The sections may be tongue and groove-interfittable as at 18*e*.

The structural detail of connector 12 of FIG. 1 is illustrated in FIGS. 2–7, to which reference is now made. Connector 12 comprises a housing 20, upstanding in FIG. 2, and having cover 22 integral with base 24, the entirety of housing 20 being formed of a suitable electrically insulative material. For reference purposes in the ensuing discussion, distance horizontally in the plane of FIG. 2 and perpendicularly to the planes of FIGS. 3 and 6 will be considered as "width". Distance horizontally in the planes of FIGS. 3 and 6 and perpendicular to the plane of FIG. 2 shall be considered as "depth". Distances in FIGS. 2, 3 and 6 in the upstanding direction of housing 20 shall be referred to as being "vertical".

Figures 2, 3, 4, 5, 6, 7:
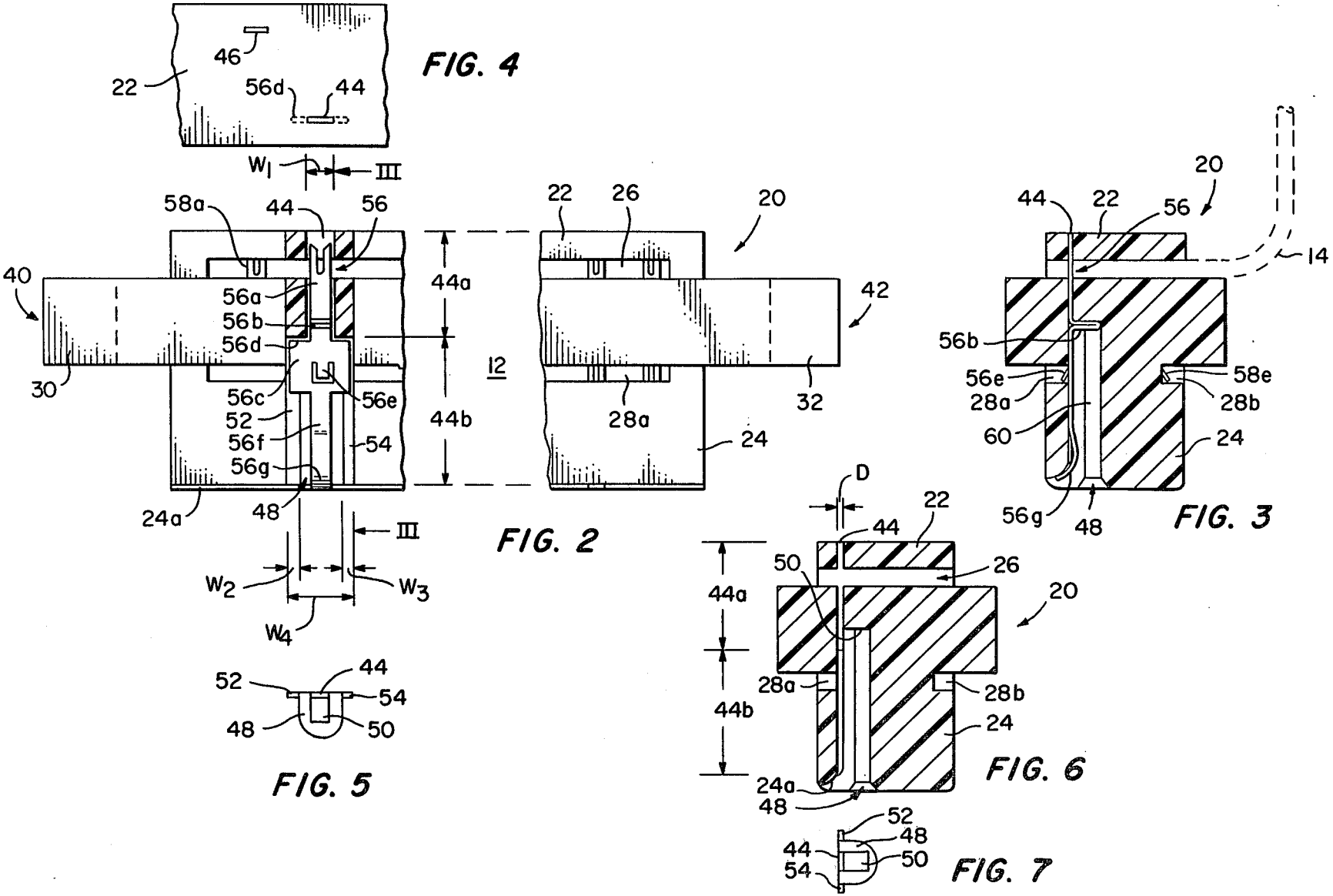
FIG. 2 is a front elevational view of the D-connector of FIG. 1, partly broken away to show interior detail.
FIG. 3 is a sectional elevation of the FIG. 2 connector as seen from broken plane III—III of FIG. 2.
FIG. 4 is a partial plan elevation of the FIG. 2 connector.
FIG. 5 is a schematic illustration, as seen from the underside of the connector of FIG. 2, with the contact element removed for clarity.
FIG. 6 is a sectional elevation, as seen from plane III—III of FIG. 2, with the contact element omitted for clarity.
FIG. 7 is a schematic illustration, as seen from the underside of the FIG. 6 showing with the contact element omitted for clarity.

Generally across its width, housing 20 defines a channel 26 situated between and in separating relation to cover 22 and base 24 for receiving flat cable 14, omitted for clarity from FIGS. 2 and 6, but shown in FIG. 3. Also extending widthwise of housing 20 are front and rear channels 28*a* and 28*b*, the purposes of which are discussed below. Wings 30 and 32 extend outboard of cover 22 and base 24 and include mounting slots 40 and 42.

A plurality of slots extend vertically through housing 20, two slots being shown at 44 and 46 in FIG. 4 and FIG. 2 being broken away to illustrate the width changes in the vertical run of slot 44. In the illustrated embodiment, slot 44 extends fully through the upper surface of cover 22 and fully through base 24, terminating adjacent base opening 48, through which pins of accessory connectors may be inserted in housing 20. Slot 44 includes a first extent 44*a* which may be characterized as being vertically adjacent channel 26 and extending into both cover 22 and base 24. Extent 44*a* is of constant depth D (FIG. 6). It is also of constant width $W_1$ (FIG. 2). Below extent 44*a*, a second extent 44*b* of slot 44 is expanded widthwise to encompass sideward slot marginal portions 52 and 54. Each such sideward slot marginal portion is also of constant depth D. However, since pin-receiving cavity 60 intervenes the two sideward slot marginal portions, the widths thereof are reduced to $W_2$ and $W_3$. The overall width of the slot, inclusive of that part of cavity 60 in registry therewith, is $W_4$.

Electrical contacts 56 and 58 are in residence respectively in slots 44 and 46, contact 56 being shown in the broken-away portion of FIG. 2 and also in FIG. 3. All contacts are identically configured, as are their residence slots. Considering contact 56, same is in fully inserted position in FIGS. 2 and 3 and in electrical connection with cable 14, which is omitted in FIG. 2 for clarity. Contact 56 includes an insulation-piercing upper end portion 56*a*, which has top cutting edges leading to a central conductor-receiving slot. Portion 56*a* is flat in profile and is of constant thickness compatible with residence of portion 56*a* in extent 44*a* of slot 44, i.e., such thickness being equal to or less than depth D of slot extent 44*a*. Contact 56 is elongate vertically in FIG. 2 and includes a stem downwardly of and continuous longitudinally with portion 56*a*. Such stem commences with folded portion 56*b*, adapted to seat against surface 50 of housing 24, surface 50 constituting an up-stop surface for contact 56. Below portion 56*b*, the stem includes an expanded width portion 56*c*, defining shoulder 56*d*, also serving to abut against the housing as an up-stop member for contact 56. Portion 56*c* also includes lanced portion 56*e*, staked or otherwise forced out of portion 56*c* to reside in channel 28*a* (FIG. 3) and abut with the lower surface of the channel to serve as a down-stop for contact 56 upon vertically upward movement thereof into insulation-piercing electrical connection with cable 14. Downwardly of stem portion 56*c* is blade portion 56*f*, adapted to emerge from the flat plane of the upper contact portions to reside outwardly in pin-receiving cavity 60 (FIG. 3), which is of depth exceeding depth D. Blade portion 56*f* comprises a second end portion of contact 56 and has its extremity 56*g* disposed flush with housing bottom undercut surface 24*a*, such that contact 56 is accessible exteriorly of housing surface 24*a* to be probed. To be noted particularly is that expanded width portion 56*c* of contact 56 has its marginal sides, which are of thickness less than depth D, in residence with sideward marginal portions 52 and 54 of slot 44. Also, it will be observed that contact portion 56*c* enters slot portions 52 and 54, in the course of contact insertion from the underside of housing 24, prior to entry of insulation-piercing portion 56*a* in the reduced width part ($W_1$) of slot 44, thus serving as a guide therefor.

By the foregoing geometry of slot 44 and contact 56, a width-stepped constant depth and thickness composite arrangement is provided as between housing slots and flat contacts, and a generally semicircular pin-receiving groove is nonetheless provided contiguously with the seated contact (FIGS. 5 and 7), facilitating both confinement of the contact for insulation-piercing of cable 14 and electrical connection with accessory apparatus. While slot 44 need be in open communication with the underside opening 48 of housing 24, the slot may terminate upwardly interiorly of cover 22. Thus, the slot need extend into the cover in its extent 44*a* only a sufficient distance vertically for the receipt and confinement, particularly in depth/thickness relation, of contact 56. Width confinement is likewise desirable, and is achieved by making the widths of contact 56 compatible with the widths ($W_1$ and $W_4$) of slot 44.

As indicated in FIG. 4, the contacts and slots are arranged in staggered horizontal rows in the depicted embodiment. Accordingly, insulation-piercing portion 58*a* of the contact in slot 46 is seen in channel 26 in FIG. 2. The lanced portion of the slot 46 contact is also seen in registry with channel 28*b* in FIG. 3.

In connector 16, shown in structural detail in FIGS. 8–11, housing 62 includes cover 64 integral with base 66. Cable-receiving channel 68 is in intervening relation to cover 64 and base 66 and is bounded thereby. Lance-registry channels 70*a* and 70*b* are provided forwardly and rearwardly of the housing for retention respectively of forward and rearward row contacts. A plurality of contact residence slots is provided, housing 62 being broken away to illustrate the vertical geometry of slot 72. The slot is, as in the case of the slots of connector 12 of FIGS. 2–7 above, widthwise stepped and of constant depth. Here, since contact 74 is of constant thickness through its vertical expanse, slot 72 is likewise configured, compatibly set in depth with the contact thickness. Insulation-piercing portion 74*a* is again provided in bifurcated fashion, defining a conductor-receiving slot. The contact stem here omits the folded portion of contact 56, as no need exists for defining a pin-receiving groove, and continues downwardly through expanded width portion 74*b*. Portion 74*b* defines abutment shoulder 74*c* and lance 74*d* and continues into terminal blade 74*e*. As seen from the undersurface of housing 62 in FIGS. 10 and 11, slot 72 includes continguous sideward portions 78 and 80. Contact 76 is shown leftwardly of contact 74 in FIG. 8, and is disposed in the rearward contact row, its expanded width portion defining lance 76*d* in registry with channel 70*b* and continuing downwardly to terminal blade 76*e*.

Various changes to and modifications of the foregoing particularly described and depicted preferred embodiments will now be evident to those skilled in the art. Accordingly, the particularly disclosed and depicted embodiments are intended in an illustrative and not in a limiting sense. The true spirit and scope of the invention is set forth in the following claims.

I claim:

1. An electrical connector for insulation-piercing termination of multiconductor flat cable, said connector comprising an upstanding housing having a cover integral with a base and a channel bounded by said cover and said base for receiving said cable, a plurality of slots accessible at the underside of said base and extending therethrough and into said cover, each such slot having an identical geometric boundary over an extent thereof in said cover and said base adjacent said channel, and a plurality of contacts, each such contact being insertable at such base underside into one of said slots and having an insulation-piercing end portion of geometry compatible with residence thereof in said slot extent.

2. The connector claimed in claim 1 wherein said geometric boundary is defined for each said slot extent by flat interior surfaces of said housing.

3. The connector claimed in claim 2 wherein such housing interior surfaces jointly define a rectangle in said cover and said base.

4. The connector claimed in claim 2 wherein said slot extent is of constant width and constant depth in said housing.

5. The connector claimed in claim 4 wherein said slot includes a further extent continuous with such first-mentioned extent and said underside of said base, such slot further extent having a width exceeding said constant width.

6. The connector claimed in claim 5 wherein said slot further extent is of said constant depth throughout over at least a widthwise portion thereof.

7. The connector claimed in claim 6 wherein said further slot extent is of said constant depth at opposed vertical side margins thereof.

8. The connector claimed in claim 7 wherein said housing defines a cavity accessible at said underside of said base and contiguous with said further slot extent, said cavity extending vertically with said further slot extent and being of depth exceeding said constant depth.

9. The connector claimed in claim 8 wherein said housing defines a pin-receiving opening at said underside of said base in communication with said cavity.

10. The connector claimed in claim 1 wherein said housing defines a further channel extending with such first-mentioned channel and disposed vertically therebelow, said contacts including retention means in registry with said further channel for retaining said contacts in said housing.

11. The connector claimed in claim 5 wherein said contact includes a stem continuous with said insulation-piercing end portion thereof, said stem being of width greater than the width of said insulation-piercing end portion and less than said width of said slot further extent.

12. The connector claimed in claim 6 wherein said contact includes a stem continuous with said insulation-piercing end portion thereof, said stem being of thickness less than said constant depth of said slot further extent over at least a widthwise portion of said stem.

13. The connector claimed in claim 7 wherein said contact includes a stem continuous with said insulation-piercing end portion thereof, said stem having an expanded width portion with vertical side margins of thickness less than said constant depth of said vertical side margins of said further slot extent.

14. The connector claimed in claim 8 wherein said contact element includes a stem continuous with said insulation-piercing end portion thereof, said stem having an expanded width portion with vertical side margins resident in said vertical side margins of said further slot extent and an end portion extending into said cavity.

15. The connector claimed in claim 14 wherein said stem end portion extends onto said underside of said housing to be accessible exteriorly of said housing.

* * * * *